US005174047A

United States Patent [19]

Gross

[11] Patent Number: 5,174,047

[45] Date of Patent: Dec. 29, 1992

[54] BOUNDARY LAYER CONTROL ROLLS

[75] Inventor: Frank R. Gross, Akron, Ohio

[73] Assignee: Gross Technology Corporation, Akron, Ohio

[21] Appl. No.: 679,734

[22] Filed: Apr. 3, 1991

[51] Int. Cl.[5] ..... F26B 13/08

[52] U.S. Cl. ..... 34/117; 34/120; 34/13; 34/114; 34/62

[58] Field of Search ..... 34/113, 114, 115, 116, 34/117, 62, 13, 155, 156, 120, 66

[56] References Cited

U.S. PATENT DOCUMENTS

| | | | |
|---|---|---|---|
| 3,771,702 | 11/1973 | Matsumo et al. | 34/156 |
| 4,185,399 | 1/1980 | Gladish | 34/114 |
| 4,263,724 | 4/1981 | Vits | 34/114 |
| 4,342,156 | 8/1982 | Wanke | 34/120 |
| 4,462,169 | 7/1984 | Daane | 34/114 |
| 4,476,636 | 10/1984 | Gross | 34/114 |
| 4,774,771 | 10/1988 | Littleton | 34/62 |
| 5,036,600 | 8/1991 | Webster et al. | 34/113 |

OTHER PUBLICATIONS

Perry, *Chemical Engineer's Handbook*, 5th Ed., McGraw-Hill, 1973, pp. 5-55 through 5-57.

*Primary Examiner*—Henry A. Bennet
*Assistant Examiner*—Denise L. F. Gromada
*Attorney, Agent, or Firm*—Oldham, Oldham & Wilson Co., LPA

[57] ABSTRACT

At least one boundary control roll is disposed adjacent a moving web of paper or like material being imprinted with ink. The web of paper has opposing planar surfaces, and at least one such boundary control roll is positioned in transverse non-contacting proximity to a planar surface of said web and rotated counter to the direction of travel of the web. If multiple rolls are used, the rolls on opposing sides of the web should be coacting and counter-rotating. The boundary layer formed about the peripheral surface of each roll is adjustably positioned within the boundary layer on adhering to the moving web. By colliding the respective boundary layers, a zone of interference is created and the boundary layer of the web is significantly reduced in thickness. In this manner, the thickness of the hot solvent-laden boundary layer adhering to each side of the web is effectively reduced.

19 Claims, 4 Drawing Sheets

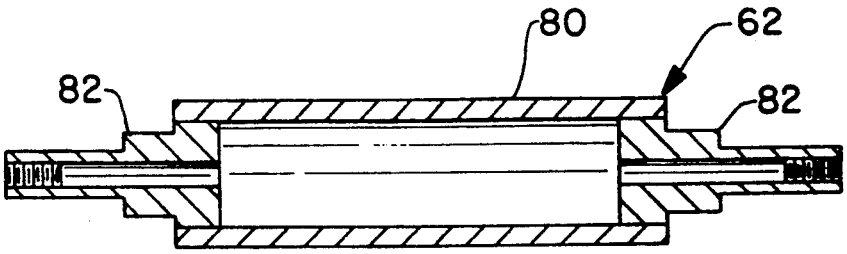
FIG.-6
FIG.-7
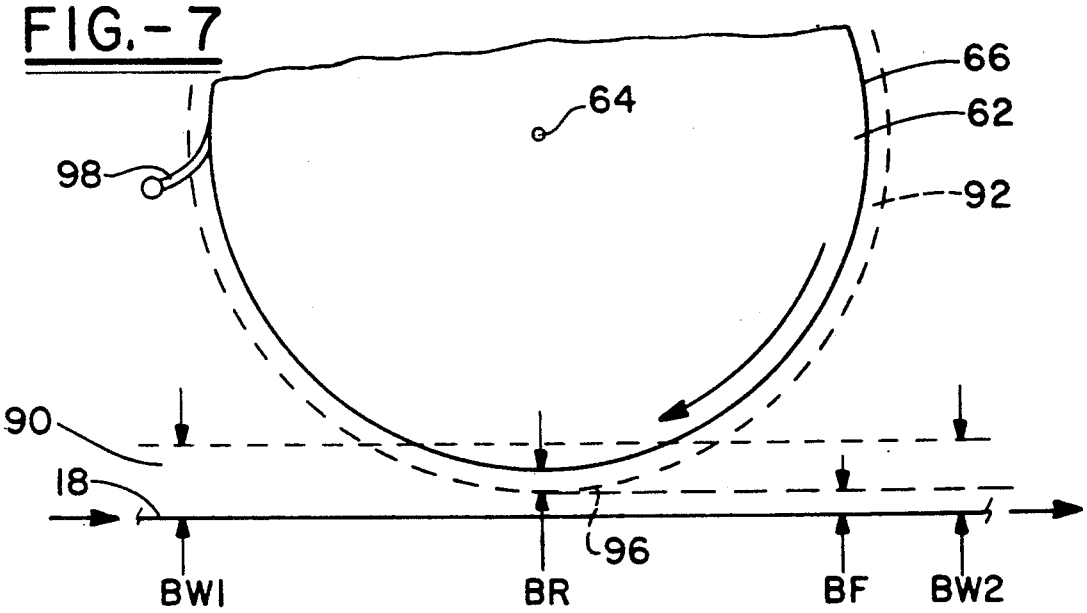
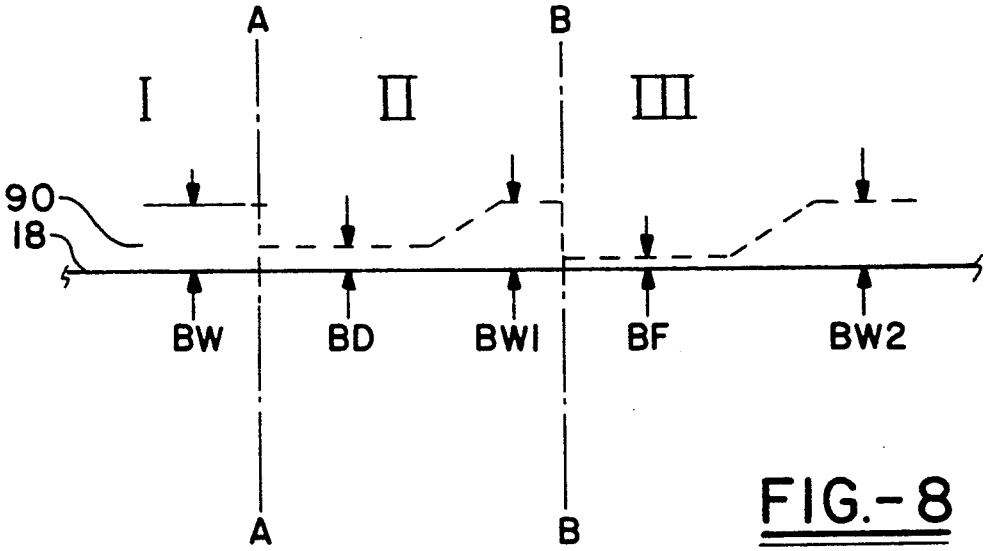
FIG.-8

BOUNDARY LAYER CONTROL ROLLS

This invention relates to the use of one or more rolls for modifying and controlling the thickness of the boundary layer adhering to at least one planar surface of a moving web. More particularly, this invention relates to the use of one or more rolls for reducing the thickness of at least one such boundary layer adhering to such a moving web where the web is a heated web, even more particularly, a heated web of hot printed paper, such as in the offset printing industry and where each boundary layer comprises hot solvent-laden air. Even further, the invention relates to one or more rolls that reduces the thickness of such boundary layer by creating a zone of interference between the roll periphery and its associated boundary layer and the boundary layer of the moving web by a rotation of the roll or rolls opposite to the direction of the web without actual contact of the roll or rolls with the moving web.

BACKGROUND ART

In the printing industry, it is well known to imprint a moving web of paper using an ink comprising a pigment and a volatile solvent. It will, of course, be recognized that although these printing inks will usually be based upon an organic solvent, the term "volatile solvent" also includes a water-based solvent under proper conditions of temperature and pressure. After such imprinting of the web, it is necessary to drive off the volatile solvent so that the ink will affix itself to the web. The web operates at a rapid speed, that is, in the range of from 300 to upwards of 2500 feet per minute, at a web tension in the range of 1 to 10 pounds per inch of web width, and the web speed and tension must be controlled by control rolls, so it is essential that the drying of the web and, consequently, the driving off of the volatile solvent, be achieved as quickly as possible. In the known art, it is common practice to run the printed web through a dryer in which jets of hot air impinge upon the respective planar surfaces of the web to heat the web and evaporate the volatile solvent. Shortly beyond the exit of the dryer, it is desirable to pass the web over one or more chill rolls to reduce the temperature of the web and to "fix" the inks imprinted upon the web. Condensation of the solvent on the chill rolls would cause smearing of the inks on the web. It is necessary, therefore, to remove as much of the solvent-laden boundary layer adhering to each planar surface of the web as is economically possible, so that a minimal amount of solvent is available to condense upon the chill rolls.

It is well known that when a flat sheet (such as a web of paper) moves relative to a fluid (such as the air through which the web moves), a stagnant boundary layer of the fluid adheres to the area near the surface of the flat sheet and that boundary layer is pulled along with the sheet or web as it moves relative to the bulk fluid. Although such boundary layers are usually considered with respect to flow of a fluid past a fixed flat sheet, for example, the flow of fluid past a stationary heat transfer surface, the situation for movement of a flat sheet, such as the web, through a fluid is analogous. It is the relative velocity difference between the fluid and the flat sheet that is relevant in determining the thickness of the boundary layer. Other important factors, all of which are clearly known and explained in the prior art, include the fluid viscosity and density. Both of these are, in turn, related to the chemical composition of the fluid, as well as its temperature. The specific calculation of the thickness of the boundary layer is well known in the art and a discussion of such calculation is presented in treatises such as Perry's "Chemical Engineer's Handbook", 5th ed., McGraw-Hill, 1973, at pages 5-55 through 5-57.

It is known in the prior art, particularly in the present inventor's U.S. Pat. No. 4,476,636, issued Oct. 16, 1984, which is incorporated herein as if fully recited, to modify the boundary air layer for a heat transfer roll. A further application of boundary layer effects is presented in U.S. Pat. No. 4,774,771, issued to Littleton on Oct. 4, 1988.

Since a web, particularly a paper web in the printing application described above, exits a hot air dryer at the high velocities commercially encountered, the web will, absent any control mechanism, carry a significant amount of a hot solvent-laden vapor with it as it exits the dryer. This has several undesirable aspects. For example, some of the common solvents, due to their chemical composition, are known to be deleterious to human health and the exposure of workers to the vapors may be limited by environmental standards. Secondly, the loss of heated air out of the exit of the dryer is also undesirable, particularly when such loss is in the stagnant boundary layer near the web, as the hot boundary layer reduces conductive heat loss from the web to the ambient environment. Even further, if the solvent-laden boundary layer is not wiped or otherwise removed prior to the encounter of the web with the chill rolls, the relative saturation of the solvent in the boundary layer may result in condensation of the solvent upon the chill rolls. In addition to decreasing contact between the web and chill roll, these solvents can smear or smudge the imprinting on the web. Although the thickness of the boundary layer so removed from the dryer is very small in relation to the width and length of the web, it will be easily recognized that the total volume of fluid thus removed is rather large per unit time, due to the high velocities utilized.

SUMMARY OF THE INVENTION

A first object of the invention, then, is to retain solvent laden hot air within the dryer chamber by modifying the boundary layer at or near the exit of the web from the dryer chamber.

A second object of the invention is to reduce heat loss from the dryer chamber by modifying the thickness of the boundary layer at or near the exit of the moving web from the dryer chamber.

An additional object of the invention is to prevent smearing of the web by ink which has been condensed on the chill rolls.

A still further object of the invention is to increase the speed at which the web may be operated by removing as a rate-limiting step the process of contacting the web with drying gas after imprinting and before chilling.

A yet further object of the invention is to require less adjustment of drier and chill roll temperature to allow proper and stable operation of the printing system.

These and other objects of the invention are achieved by an apparatus used in connection with a process for setting ink to a moving web of paper having opposing first and second planar surfaces, said apparatus, used for reducing the thickness of a boundary layer adhering to each said planar surface, comprising: one or more boundary control rolls, at least one such roll being positioned in transverse non-contacting proximity to an opposing planar surface of said web; and means for rotating each said boundary control roll in a coacting fashion in a direction opposite to the direction of said web between said rolls at a velocity sufficient to effectively form a boundary layer around the peripheral surface of each said roll. In a preferred embodiment the apparatus further comprises means for adjustably positioning each said roll relative to said moving web. In such an embodiment, each said roll may be positioned relative to said moving web such that the peripheral surface of each said roll is closer to said moving web than the combined thicknesses of the respective boundary layers adhering to the surface of the roll and the planar surface of the web. Further, each said roll is positioned relative to the moving web such that the boundary layer adhering to the periphery of each roll creates a zone of interference with the boundary layer adhering to said web planar surface to significantly remove said boundary layer from said web. The preferred apparatus is such that each said boundary control roll has a means for wiping the peripheral surface thereof mounted within operative proximity thereto, and the preferred wiping means is a blade, with a flexible blade being even more preferred. It is preferred that each said boundary control roll be of the same diameter and rotate at the same velocity. In one preferred embodiment, two such boundary control rolls are positioned such that the plane containing the longitudinal axes of said rolls is perpendicular to the plane of said moving web. In another preferred embodiment, at least three boundary control rolls are positioned on alternating sides of said web such that the longitudinal axes of said rolls are in relative triangular relationship, when viewed from the ends of said axes. In a yet further embodiment, at least four boundary control rolls are positioned on alternating sides of said web such that the longitudinal axes of said rolls are in relative rectangular relationship, when viewed from the ends of said axes. In an apparatus of the preferred embodiment, each said roll has its peripheral surface adapted for maximizing the thickness of the boundary layer created by the rotation of said roll. Such rolls are positioned fully or partially internal to the dryer or close to the exit of the dryer. In an alternative embodiment, at least one such boundary control roll is external to the dryer and proximate to the exit of said web from said dryer. In one preferred embodiment, at least one of the boundary control rolls has means for passage of heat transfer medium disposed therethrough.

Even further objects of the present invention are achieved by a process used in connection with a process for setting ink to a moving web of paper having opposing first and second planar surfaces, each said planar surface having an adhering boundary layer of hot solvent-laden gas associated therewith as a result of the setting process, said process comprising: rotating one or more boundary control rolls, each such roll in transverse non-contacting proximity to an opposing planar surface of said web, said rotation at a velocity sufficient to effectively form a boundary layer around the peripheral surface of each said roll, said rotation further being in a direction opposite to the direction of said web; and colliding the boundary layer thus formed on each said roll with said boundary layer of hot solvent-laden gas on one planar surface of said web, thereby creating a zone of interference to significantly remove hot solvent-laden boundary layer from the planar surface. In a preferred embodiment the further step of wiping the peripheral surface of each boundary control roll with a means for wiping after the removal of said hot solvent-laden boundary layer from said planar surface is incorporated. In an even further embodiment, the process also comprises the step of passing heat transfer medium through the interior of at least one said boundary control roll for controlling the temperature of the peripheral surface of said roll.

BRIEF DESCRIPTION OF THE DRAWINGS

For a better understanding of the invention, reference should be had to the accompanying drawings, wherein:

FIG. 1 is a schematic illustration of the process known in the prior art for imprinting a web with ink or the like;

FIG. 6 is a cross-sectional view of the present invention, disclosing internal structures thereto;

FIG. 7 is a detail view of the present invention in operation with a web of paper or the like, illustrating the interaction of the respective boundary layers;

FIG. 8 is a diagram illustrating theoretical changes in the boundary layers due to the operation of the present invention;

DETAILED DESCRIPTION OF THE INVENTION

Figure 1:
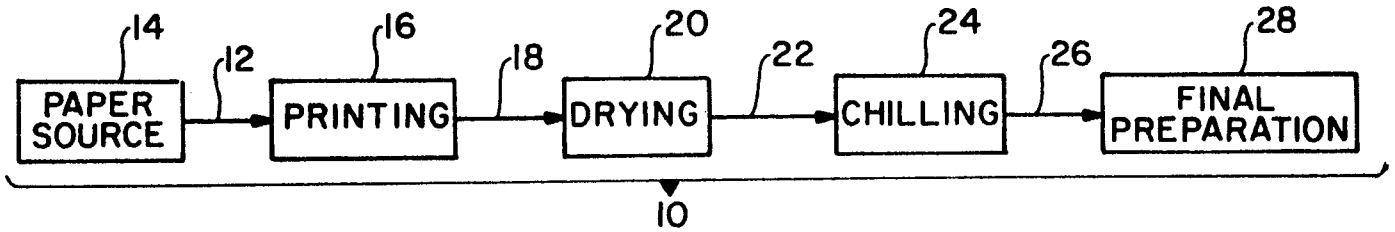
FIG.-1 Prior Art

FIG. 1 illustrates schematically the procedures followed in printing of inks or the like onto an essentially continuous web, particularly one of paper, in a press device 10 such as an offset printing press. The specifics of such presses are well known in the art. A web of unprinted paper 12 is drawn from a paper source 14 and fed into a printing device 16, wherein a series of manipulating rolls (not shown) are used to print upon the web, either on one side or on both sides of the web. The now-imprinted web 18 of paper exiting the printing device 16 still contains a large amount of the solvent associated with the printing inks. The concentration of such solvent near the surface of the web 18, particularly in the boundary layer formed near the planar surfaces of the web, will approach the saturation point, at which the solvent will condense out of the vapor phase. To permit easy handling of the web 18 without smearing the printing, the web is passed through a drying device 20 wherein hot air impinges upon the web. This impingement of hot air has basically two effects: 1) to warm the moving web; and 2) to decrease the relative concentration of solvent at or near the web surface by replacing it with relatively solvent-free gas.

Although the web 22 which emerges from the drying device 20 is usually dry enough from the solvent itself that it could be handled directly by rolls, the web 22 emerges with a relatively concentrated boundary layer of solvent vapor still adhering to each side thereof. To fix the inks and to permit the web 22 to be easily manipulated in a final preparation stage 28, the web 22 is passed through a chilling device 24, where a series of heat transfer rolls (not shown) are used to directly contact the web and cool it. The inventor's prior U.S. Pat. No. 4,476,636 shows a typical arrangement for positioning such heat transfer rolls. Since this cooling could cause the temperature of the boundary layer gases to drop below the saturation point of the solvent, resulting in solvent condensation on the chill rolls and since the solvents used are known to be deleterious to human health, it is desirable to remove as much of the hot solvent-laden boundary layer gas from the web 22 as it emerges the drying device 20 as possible. An ideal location or situs to achieve this removal or reduction of the boundary layer of web 22 is at or near the exit of the drying device 20.

Once the paper web 26 has been chilled through chilling device 24, the web 26 is passed to a final preparation operation 28 where the web 26 is cut, bound, and otherwise manipulated into the final paper product (not shown), which then passes into the stream of commerce.

The economics of operation of a printing machine 10 as shown in FIG. 1 are largely dictated by the capacity of such a machine, as expressed in thickness and composition of web imprintable per unit time. As currently practiced, the most common rate-limiting factor is not the peak velocity at which the web may be safely and controllably handled by the web drives. Instead, it is the capacity of the machine 10 to dry the inks applied to the web between the time at which they are imprinted upon the web and when the web encounters the chill rolls, particularly the time and distance required to achieve such drying. Typical web speeds are in the range of from about 300 to speeds upwards of about 2500 feet per minute, although faster speeds are clearly achievable without adversely affecting the quality of printing, if sufficient drying could be achieved. An alternate method of achieving such drying would be to increase the distance between the printing and drying operations or the drying and chilling operations, during which the unimpeded web would have time to dry. However, this alternative is clearly not economical, as the result of lengthening such web runs is inefficient use of floor space, usually at a premium in printing plants. Further, long, unfettered runs of web moving at high speeds pose safety hazards.

Since the thickness of the boundary layer associated with the web clearly is affected by the velocity of the web, it is very desirable to modify or reduce the size of the boundary layer in order to increase the efficiency of the printing operation.

Figure 2:
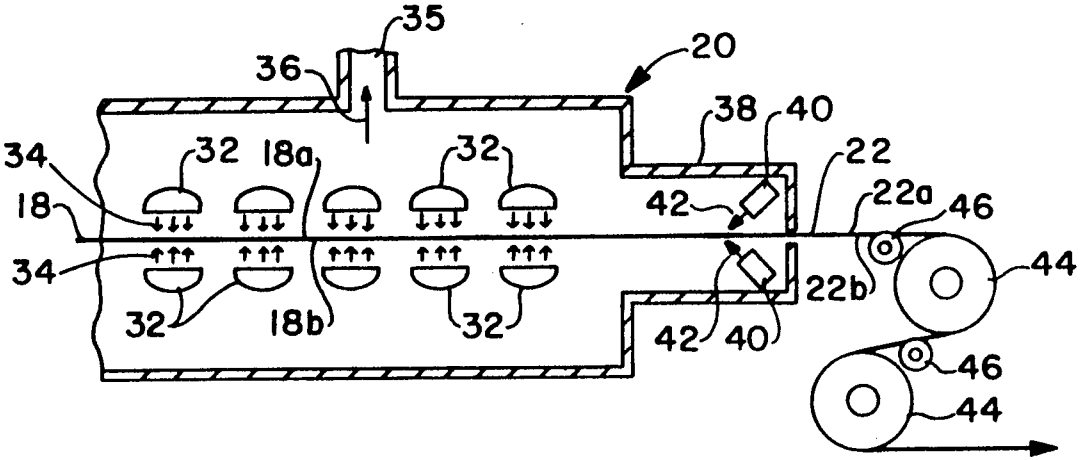
FIG.-2 Prior Art
FIG. 2 is an internal view of a typical prior art dryer for drying the inks from the web.

One solution to the present problem that has been utilized in the prior art is illustrated in FIG. 2, which shows a typical prior art drying device 20, such as presented schematically in FIG. 1. A moving web of paper 18, which has previously been imprinted with inks and is still wet with the ink solvents, passes between a plurality of nozzles 32 that impinge hot solvent-free gas 34, particularly compressed air, upon the opposing sides 18*a* and 18*b* of web 18. A vent 35 allows the solvent-laden air 36 of the dryer 20 to be withdrawn from the proximate work area and safely handled.

An extension 38 at the end of dryer 20, commonly called a smoke tunnel, typically presents at least two air nozzles 40 for impinging a further oblique stream of compressed air 42 against the web sides 18*a* and 18*b* as the web 18 exits dryer 20. After the leaving the dryer 20, the now-dried web 22 encounters the chill rolls 44, which were presented very schematically as chilling device 24 in FIG. 1. When more than one chill roll 44 is used, it is necessary for each side, 22*a* and 22*b*, of web 22 to contactingly engage at least one of the chill rolls 44. Even if printing is placed upon only one side 22*a* or 22*b*, therefore, it will be necessary to have that side contact a chill roll 44. A further feature shown in FIG. 2 are boundary layer control rolls 46, which are the subject of the inventor's prior U.S. Pat. No. 4,476,636. Such boundary layer control rolls 46 will be useful in reducing the thickness of the boundary layer at the chill rolls 44, but the present invention seeks to enhance the capabilities of rolls 44, and not to replace or duplicate their functionality.

Figure 3:
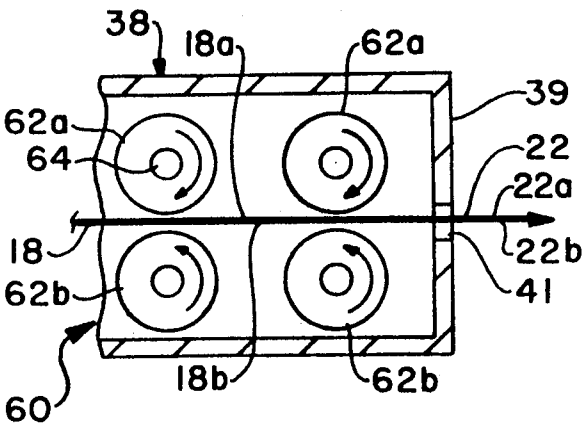
FIG. 3 is an internal view of the exit portion of the dryer of FIG. 2, showing the present invention as installed therein, utilizing two pairs of rolls in rectangular pitch.

FIG. 3 presents the present invention 60 as preferably positioned in an extension end 38 of a dryer 20, similar to the one known in the prior art and shown in FIG. 2. In such an extension end, there is an exit wall 39 and an exit portal 41, through which the web 18 emerges from the extension, becoming web 22 by doing so. Through principles described more fully later, at one coacting roll 62, and possibly two or more, are positioned such that one roll 62*a* or 62*b* is on each side of web 18*a* or 18*b*. The rolls 62 are rotated in a direction opposite to that of the web 18 by an external driving means, which is not shown in this FIGURE, but which would act along the respective axes 64 of rolls 62. The preferred method of operating any roll 62 is so that any additional roll which with it acts is identical to the first roll 62, in terms of length, diameter and surface finish, and so that the rotational velocity of each roll is identical, but the person of skill in this art will know how to vary roll diameter and velocity between any given set of rolls so as to achieve the same result as would be achieved by coacting identical rolls.

Although it may be preferable to position the coacting rolls 62 inside the smoke tunnel 38 at the exit of the dryer 20, other positions are possible and may be preferred, depending upon the exact application and process variables, including whether the rolls are being retro-fitted to an already existing dryer device 20. As described above, positioning of the rolls 62 external to the dryer 20 is not precluded, nor would not render the invention inoperative. It would also be possible, and preferable in certain circumstances, to actually have the rolls 62 and associated wiper blades (as further shown and explained with relation to FIG. 11) effectively form the exit wall of the tunnel 38.

Figure 9:
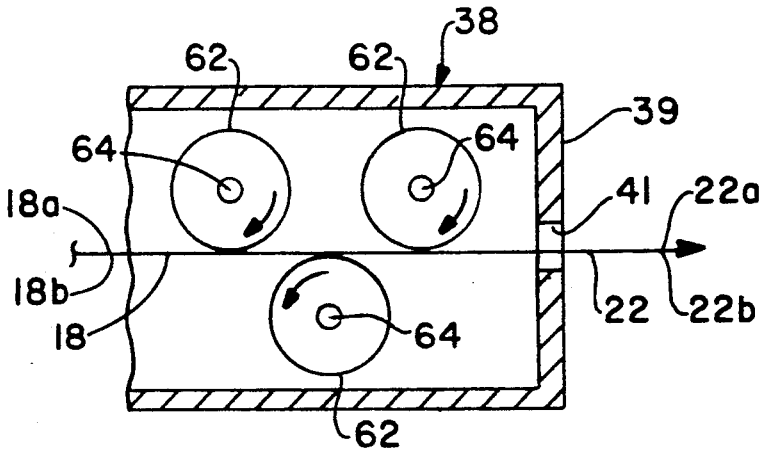
FIG. 9 is an internal view of a portion of the dryer of FIG. 2, showing the present invention as installed therein, utilizing at least three rolls in triangular pitch.

Although FIG. 3 illustrates an embodiment of the invention 60 in which two pairs of identically sized rolls 62 are used to achieve the desired effect, it will be clear that one roll or more than two pairs, properly sized and positioned according to the teachings herein, could be efficaciously utilized. For example, FIGS. 4 and 5, which illustrate the exact structures of the invention 60 will rely upon a single pair of rollers 62. But FIG. 7 illustrates the use of a single roll 62 to treat a single side of the web 18. Also, it is not required that the rolls be paired. By offsetting the rolls in a manner such that the longitudinal axes 64 of the rolls are in a triangular pitch when viewed from the side of the web, an odd number of rolls may be effectively utilized. Such an offset positioning of an odd number of rolls 62 is illustrated in FIG. 9. It is important to note that the relative placement of multiple pairs of rolls is critical to the invention. Since the web 18 must be unsupported and untouched as is passes from the left side of FIG. 3 through to the right side of the FIGURE, the web 18 must pass through the FIGURE in a linear manner, as no external deflecting force can be applied. A logical preference, therefore, for placement of the rolls 62 relative to the web in a balanced manner requires that the longitudinal axes 64 of the rolls 62 be such that a line connecting corresponding rolls 62*a* and 62*b* on opposite sides of the web 18 would be normal to the plane of the web 18.

Figure 4:
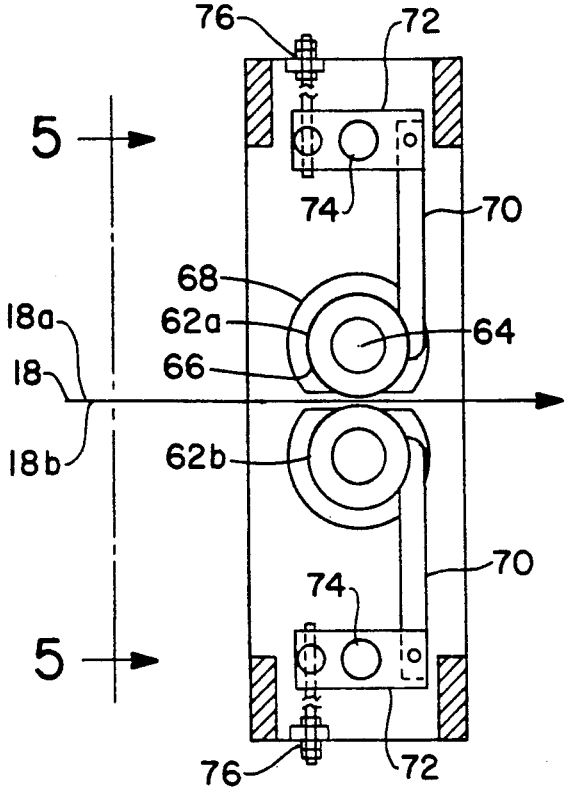
FIG. 4 is a side elevation view of the present invention, disclosing further features of the invention.

Directing attention now to FIG. 4, an elevation view of a typical pair of rolls 62 of the present invention 60 is disclosed. The elevation in FIG. 4 is taken in a direction perpendicular to the movement of the web 18 through the dryer 20. A first roll 62*a* is positioned on a first side of the web 18*a* such that an adjustably fixed distance exists between the web and the peripheral surface 66 of the roll. A coacting second roll 62*b* is adjustably positioned at an identical distance on the opposite side of the web. Since the rolls 62 are identically equipped and instrumented, detailing of features of either the upper or first roll 62A or the lower or second roll 62B would be sufficient to describe the outfitting of the other such roll. Roll 62*a* is rotatingly affixed into an end plate 68 so that roll 62*a* may rotate along its longitudinal axis 64 within such end plate 68. The end plate 68 is integral with or rigidly affixed to an adjustment arm 70. This adjustment arm has its point of attachment to the end plate offset from the longitudinal axis 64 of roll 62 so that motion of the arm 70 can adjust the displacement of the roll 62 from the moving web 18.

In the embodiment shown in FIG. 4, tuning of the adjustment arm 70 is achieved by pivoting of the adjustment arm about a lever plate 72 which utilizes an adjustment shaft 74, preferably centrally located and preferably located so that it is parallel to the axis of the boundary layer roll. At the first end of the lever plate, the adjustment arm 70 is removably affixed. At the second end of the lever plate, an adjustment screw mechanism 76 is also removably affixed. By this manner, adjustments to the adjustment screw on the second side of the lever plate 72 will correspond to an adjustment of the adjustment arm and, corresponding to the end plate. It would also be possible by known means to interlink the adjustment screws on the first and second roll 62*a* and 62*b*, respectively, so that a single adjustment would adjust both the first and second roll simultaneously in an identical manner. Also, the end plates and adjustment mechanism shown at one end of the boundary layer roll would be duplicated at the second end of each roll so that the adjustment of one end of the roll would result in an identical adjustment to the opposite end, resulting in the roll 62 being maintained in a parallel relationship to the web 18. This method of adjustment is preferred in all embodiments of the invention, regardless of the exact number of rolls 62 employed.

Figure 5:
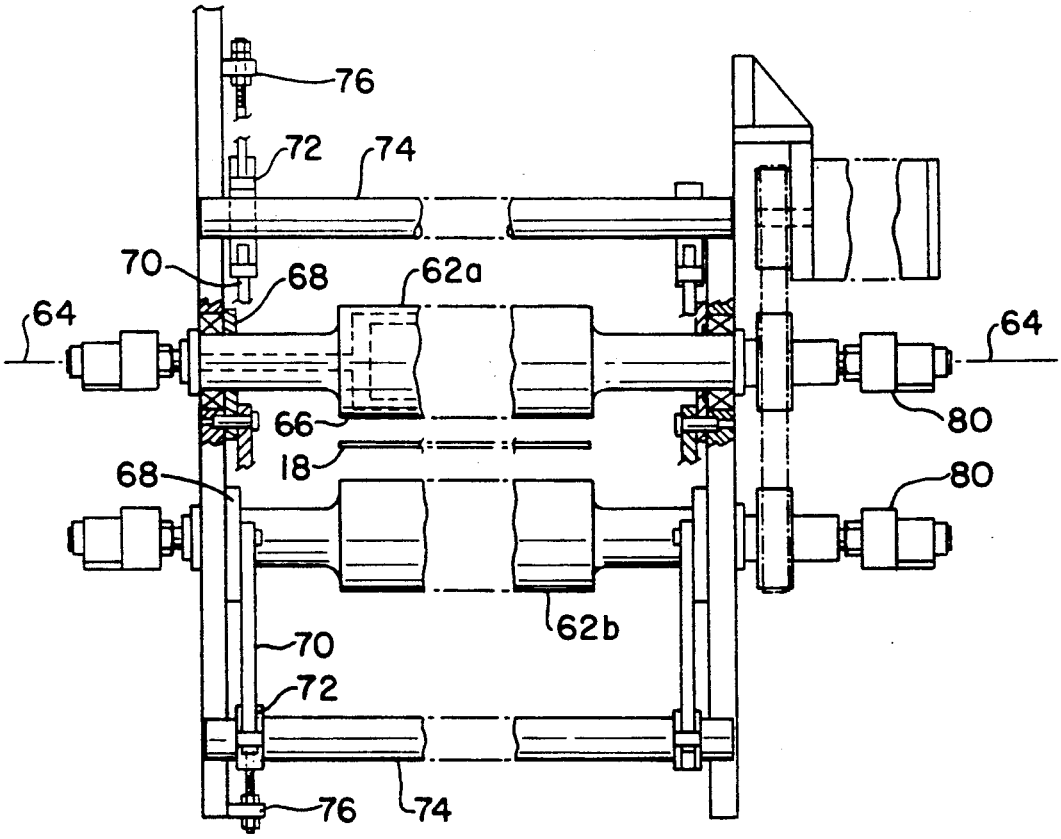
FIG. 5 is a end elevation view of the present invention.

Directing attention now to FIG. 5, taken along line 5—5 in FIG. 4, an elevation view of a typical pair of rolls 62 of the present invention is disclosed, but this view is taken in a direction in line with the direction of web flow. In this FIGURE, the use of identical end mechanisms comprising adjustment arm 70, lever plate 72, adjustment shaft 74 and adjustment screw mechanism 76 as described above, at each end of each roll 62 is clearly indicated. Further, the use of a variable speed motor 80 to drive the individual rolls is also indicated. The width of each boundary layer roll between the end mechanisms should be large enough that each roll 62 extends at least as far as the width of the web 18 to be processed through the mechanism.

Further features of the boundary roll itself are illustrated in FIG. 6. The roll itself is a simple roll 80 having journals 82 mounted on opposite ends to allow it to be rotatingly mounted. The roll 62 may have a soft rubber or plastic peripheral surface, or it may utilize a steel or chrome plated surface that would allow extremely tight tolerance along the length of the roll. Although it would be possible to utilize a solid roll, it is clearly preferable to have each roll capable of containing cooling material, particularly a liquid such as water that is efficient as a heat transfer medium. Although the rolls, like the rolls in the inventor's previous U.S. Pat. No. 4,476,636, are not intended to be in actual contact with the web, the near passage of the web and the hot gases near the roll may cause enough heat to be transferred to the roll 62 that some cooling will be desired.

It is extremely important for the operation of this type of roll 62 that it should have a surface capable of building up and maintaining a significant boundary layer thickness so that a boundary layer is available to collide with the oncoming boundary layer of the web. Schematically as shown in FIG. 7, the effect of roller 62 in reducing or wiping off the boundary layer 90 associated with web 18 is accomplished without actually contacting web 18. As illustrated, roll 62 has a rotation that is directionally opposite to the direction of motion of web 18. The peripheral surface 66 of roll 62 is specially adapted so as to maximize the thickness BR of the boundary layer 92 that it carries with it. Although the relative dimensions of the boundary layers with relation, particularly to the roll 62, are exaggerated for purpose of illustration in FIG. 7, will be noted that one of skill in this art will be able to reliably position roll 62 in juxtaposition to web 18 such that the periphery 66 of roll 62 will edge into the depth of the web boundary layer 90 having thickness BW1. Certainly it is clearly possible to position roll 62 such that at least the periphery 66 of roll 62 plus its additional boundary layer 96 of thickness BR will enter into the depth of the boundary layer 90 of web 18. At the point indicated as 96, that is, the point at which roll 62 makes its closest approach to web 18, the collision of roll 62 and its moving boundary layer 92 will impact or collide with the moving boundary layer 90 of the web 18, creating a zone of interference. As a result, the thickness of the boundary layer at a point immediately after the collision will be significantly reduced, to a thickness similar to that shown as BF in FIG. 7. Although thickness BF is shown as being extended outwardly, it is clear from theory that the continued motion of the web 18 will cause the web boundary layer 90 to increase to a thickness BW2, which may or may not be identical to BW1.

As the thickness of the web boundary layer 90 increases from BF to BW2, it should be recognized that this represents the introduction of a volume of new gas adjacent to web 18. This new gas, if it is cooler and contains less solvent, will be able to achieve cooling and solvent removal capabilities that would not have been possible with the boundary layer represented as BW1 which contained hot, solvent laden vapor.

A further feature shown in FIG. 7 is the optional use of a wiper blade 98 to shed the boundary layer 96 on roll 62. In the particular application shown in FIG. 3, the preferable position for such a wiper blade 98 would be at a point within 180 degrees, and preferably within 90 degrees, or so of the point of collision 96 of the respective boundary layers. The purpose of such a wiper blade 98 is to clean off the boundary layer 98 remaining on the roll so that any hot solvent-laden gas in such a boundary layer is not able to recirculate and thereby establish an equilibrium concentration of such gas in the boundary layer, defeating the purpose of such roll. By positioning the wiper blade 98 at such proximity to the boundary layer collision point 96, the time for a new boundary layer 92 to form on the roll 62 is maximized. It will be recognized that in certain other applications, particularly the application shown in FIG. 11 where the rolls 62 and the associated wiper blades effectively form the exit from the tunnel 38, it will be necessary to position the blades at a position 180 or more degrees from the boundary layer collision point 96.

FIG. 8 also illustrates in a schematic form the adjustments made in the boundary layer 90 of the web 18 as it moves from left to right through the dryer as was previously taught in FIG. 3. In the zone generally indicated by I, the web 18 enters the dryer with a boundary layer 90 of thickness BW. At the point indicated by line AA, the web enters the portion of the dryer where the nozzles impinge hot relatively solvent free gas upon the web, which is generally shown as II. This impingement results in a reduction of the boundary layer 92 by a scrubbing away of some of the previously solvent laden gas. This new boundary layer has a reduced thickness dimension BD in FIG. 8. As the web continues to move past the nozzles, however, the motion of the web will result in the increase of boundary layer to dimension BW1. Since the available air to be added to boundary layer BW1 is hot solvent laden gas, this is the gas that needs to be removed by the method as shown in FIG. 7. At the point of line BB the present invention is practiced upon the web, resulting in reduction of the boundary layer 90 to thickness BF and as the web moves away from the control rolls, the increase to thickness BW2 occurs as shown in zone III of FIG. 8. The thickness BW2 of boundary layer 90 may differ from the thickness of boundary layer BW1 due to changes in the temperature and viscosity of the gas accompanying the web. It is well known that the major variables involved in the thickness of an boundary layer involve temperature, viscosity of the gas, and velocity of the web relative to the environment, as well as the distance from the location at which it was formed.

Figure 10:
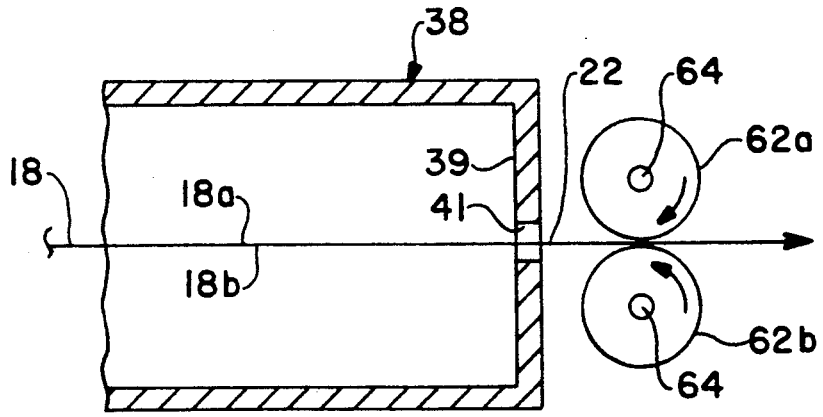
FIG. 10 is an internal portion of the dryer of FIG. 2 and the area proximate thereto, showing the present invention as installed in an alternate embodiment.

FIG. 10 illustrates a further embodiment of the invention wherein the rolls 62 are not able to be fitted within the dryer tunnel 38 and must be positioned proximate to the tunnel exit, at which point the web is indicated as feature numeral 22 rather than 18, although the operative use of the invention is identical.

Figure 11:
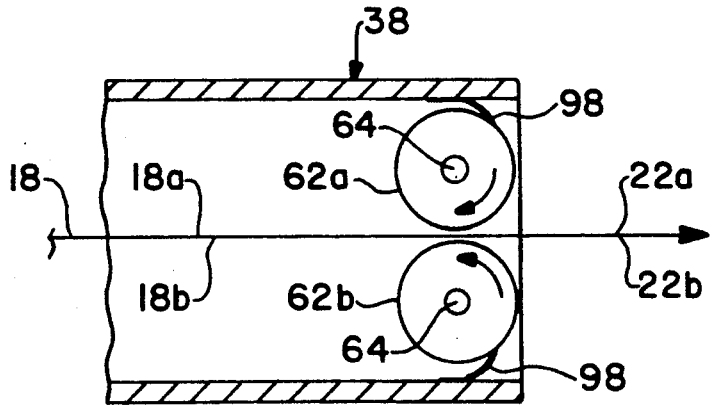
FIG. 11 is an internal portion of the dryer of FIG. 2 and the area proximate thereto, showing the present invention as installed in a further embodiment.

A yet further embodiment of the invention is shown in FIG. 11, where the boundary layer control rolls 62*a* and 62*b*, as presented earlier in this application, are positioned in an extension or tunnel 38 of the dryer 20 similarly to that presented in FIG. 3, with the difference being that the rolls 62 and their associated wiper blades 98 effectively constitute the exit wall of the extension 38. Stated differently, the rolls 62 and associated wiper blades 98 replace the function of exit wall 39 and exit portal 41 shown in FIG. 3.

It will further be appreciated by those persons skilled in the manipulation of paper webs that although this specification is directed to removal of ink solvents from the boundary layer of a web of finished paper, similar problems are faced in the paper making art, where the "solvent" that needs to be removed is the water that is used in connection with the pulp in preparing the paper web. Therefore, application of this invention to the drying of such a paper web is clearly within the anticipation of this disclosure.

While in accordance with the patent statutes, the best mode and preferred embodiment of the invention have been described, it is to be understood that the invention is not limited thereto, but rather is to be measured by the scope and spirit of the appended claims.

What is claimed is:

1. An apparatus used in combination with an device for setting ink to a moving web of paper having opposing first and second planar surfaces, said apparatus for reducing the thickness of a boundary layer adhering to each said planar surface comprising:

a) at least two boundary control rolls, at least one said boundary control roll positioned in transverse non-contacting proximity to the first planar surface and at least one additional said boundary control roll positioned in transverse non-contacting proximity to the second planar surface; and b) means for rotating each said boundary control roll in a coacting fashion in a direction opposite to the direction of said web past said boundary control roll at a velocity sufficient to effectively form a boundary layer around the peripheral surface of each said boundary control roll, said rotation of said boundary control roll being independent of web movement.

2. An apparatus according to claim 1 further comprising means for adjustably positioning each said boundary control roll relative to said moving web.

3. An apparatus according to claim 1 wherein each said boundary control roll is positioned relative to said moving web such that the peripheral surface of each said boundary control roll is closer to said moving web than the combined thicknesses of the respective boundary layers adhering to the surface of the boundary control roll and the planar surface of the web.

4. An apparatus according to claim 3 wherein each said boundary control roll is positioned relative to said moving web such that the boundary layer adhering to the periphery of each said boundary control roll creates a zone of interference with the boundary layer adhering to said web planar surface to significantly remove said boundary layer from said web.

5. An apparatus according to claim 1 wherein at least one said boundary control roll has a means for wiping the peripheral surface thereof mounted within operative proximity thereto.

6. An apparatus according to claim 5 wherein the wiping means is a flexible blade.

7. An apparatus according to claim 1 wherein each said boundary control roll is of the same diameter.

8. An apparatus according to claim 7 wherein each said boundary control roll rotates at the same velocity.

9. An apparatus according to claim 1 wherein two such boundary control rolls are positioned such that the plane containing the longitudinal axes of said boundary control rolls is perpendicular to the plane of said moving web.

10. An apparatus according to claim 1 wherein at least three boundary control rolls are positioned on alternating sides of said web such that the longitudinal axes of said boundary control rolls are in relative triangular relationship, when viewed from the ends of said axes.

11. An apparatus according to claim 1 wherein at least four boundary control rolls are positioned on alternating sides of said web such that the longitudinal axes of said boundary control rolls are in relative rectangular relationship, when viewed from the ends of said axes.

12. An apparatus according to claim 1 wherein each said boundary control roll has its peripheral surface adapted for maximizing the thickness of the boundary layer created by the rotation of said boundary control roll.

13. An apparatus according to claim 1 wherein all said boundary control rolls are internal to a device for drying and setting said ink on said web.

14. An apparatus according to claim 1 wherein at least one such boundary control roll is external to a device for drying and setting said ink on said web and proximate to the exit of said web from said device.

15. An apparatus according to claim 5 wherein two boundary control rolls and the flexible wiper blade associated with each said boundary control roll effectively forms an exit wall from a dryer device through which the web passes.

16. An apparatus according to claim 1 wherein at least one said boundary control roll has means for passing heat transfer medium disposed therethrough.

17. A process used in combination with a process for setting ink to a moving web of paper having opposing first and second planar surfaces, each said planar surface having an adhering boundary layer of hot solvent-laden gas associated therewith as a result of the setting process, said process comprising:

a) rotating at least one boundary control roll in transverse non-contacting proximity to each opposing planar surface of said web, said rotation at a velocity sufficient to effectively form a boundary layer around the peripheral surface of each said boundary control roll, said rotation further being in a direction opposite to the direction of said web; and b) colliding the boundary layer thus formed on each said boundary control roll with said boundary layer of hot solvent-laden gas on one planar surface of said web, thereby creating a zone of interference to significantly remove hot solvent-laden boundary layer from the planar surface.

18. A process according to claim 17 further comprising the step of wiping the peripheral surface of each boundary control roll with a means for wiping.

19. A process according to claim 18 further comprising the step of passing heat transfer medium through the interior of at least one said boundary control roll for controlling the temperature of the peripheral surface of said roll.

* * * * *